US006122796A

United States Patent [19]

Downham et al.

[11] Patent Number: 6,122,796

[45] Date of Patent: Sep. 26, 2000

[54] SUCTION CLEANING APPARATUS

[75] Inventors: David Downham, Flitwick; John Michael Ord, Leighton Buzzard, both of United Kingdom; Thomas Jankevics, S-Vallingby; Goran Sjoberg, Kungsangen, both of Sweden

[73] Assignee: Electrolux Household Appliances Limited, Luton, United Kingdom

[21] Appl. No.: 09/077,770

[22] PCT Filed: Dec. 4, 1996

[86] PCT No.: PCT/GB96/02995

§ 371 Date: Nov. 2, 1998

§ 102(e) Date: Nov. 2, 1998

[87] PCT Pub. No.: WO97/20492

PCT Pub. Date: Jun. 12, 1997

[30] Foreign Application Priority Data

| | | | |
|---|---|---|---|
| Dec. 4, 1995 | [GB] | United Kingdom | 9524751 |
| Dec. 4, 1995 | [GB] | United Kingdom | 9524774 |
| Aug. 28, 1996 | [SE] | Sweden | 9603114 |

[51] Int. Cl.[7] ..... A47L 5/22

[52] U.S. Cl. ..... 15/328; 15/329; 15/352; 15/344

[58] Field of Search ..... 15/312.1, 352, 15/328, 329

[56] References Cited

U.S. PATENT DOCUMENTS

| | | | |
|---|---|---|---|
| 2,456,639 | 12/1948 | Lanter | 15/329 X |
| 4,573,236 | 3/1986 | Dyson | 15/333 |
| 4,660,246 | 4/1987 | Duncan et al. . | |
| 4,960,446 | 10/1990 | Werner et al. | 55/312 |
| 4,980,945 | 1/1991 | Bewley | 15/339 |
| 5,054,157 | 10/1991 | Werner et al. | 15/328 |
| 5,309,600 | 5/1994 | Weaver et al. | 15/328 |
| 5,404,614 | 4/1995 | Stephens | 15/328 X |
| 5,410,775 | 5/1995 | Frazier . | |
| 5,524,321 | 6/1996 | Weaver et al. | 15/329 |
| 5,983,444 | 11/1999 | Jacobs et al. | 15/329 |

FOREIGN PATENT DOCUMENTS

| | | |
|---|---|---|
| 100438 | 2/1984 | European Pat. Off. . |
| 039437 | 7/1984 | European Pat. Off. . |
| 267056 | 5/1988 | European Pat. Off. . |
| 778577 | 7/1957 | United Kingdom . |
| 823145 | 11/1959 | United Kingdom . |
| 1394497 | 5/1975 | United Kingdom . |
| 2126471 | 3/1984 | United Kingdom . |

OTHER PUBLICATIONS

Patent Abstracts of Japan, vol. 16, No. 375, (C–0973), Aug. 12, 1992 & JP 04 122329 A (Matsushita Electric Ind Co Ltd), Apr. 22, 1992.

*Primary Examiner*—Chris K. Moore
*Attorney, Agent, or Firm*—Pearne & Gordon LLP

[57] ABSTRACT

A suction cleaner comprises a primary cleaner (1) and an auxiliary cleaner (2). The primary cleaner 1 includes a fan (11) for sucking in air, and an air channel (6,7,9) disposed upstream of the fan for directing sucked air through the primary cleaner. The auxiliary cleaner (2) includes a dust collection chamber (20) and is attachable to the primary cleaner (1) with the dust collection chamber connected to the air channel (6,7,9) such that, in use, dust within the dust collection chamber is drawn into the air channel for collection.

35 Claims, 7 Drawing Sheets

SUCTION CLEANING APPARATUS

This invention relates to a suction cleaner, and in particular to a suction cleaner comprising a primary cleaner and an auxiliary cleaner attachable to the primary cleaner.

This invention also relates to a suction cleaner of the type comprising a housing having a dust container and filter, the dust container being connected to an inlet opening and to a motor-fan unit such that the motor-fan unit creates an air flow via the inlet opening into the dust container and through the filter to atmosphere. Dirt carried by the air flow is separated from the air flow and retained in the dust container by the filter.

A conventional suction cleaner is disclosed in British patent specification 2 126 471 (hereafter referred to as '471). This suction cleaner is a combination of an upright vacuum cleaner and a hand-held suction cleaner. The upright cleaner has a rigid housing, the rigid housing having a pocket in which the hand-held suction cleaner is received. The hand-held cleaner is an accessary for the upright cleaner. This arrangement has a number of disadvantages. For example, when the hand-held cleaner is used, dust is collected in a dust chamber within the hand-held cleaner; and, when the upright cleaner is used, dust is collected in a dust collection bag within the upright cleaner. It is, therefore, necessary to empty two different dust containers instead of one. The dust collection bag of the upright cleaner is normally disposable, so that dust collected therein is disposed of without spillage. The hand-held cleaner does not include a disposable dust bag, having instead a collection chamber and a dust filter disposed between the collection chamber and the fan. To empty the collection chamber, the filter is removed, and the collected dust shaken out. This can result in spillage of the dust.

If both the upright cleaner and the hand-held cleaner are mains powered, it is either necessary to include two separate power cables or to include a single power cable which may be selectively plugged into one or other cleaner. In this latter case, if the upright cleaner is pushed so that the power cable is pulled tight, the power cable will fall out of the upright cleaner and the cleaner will stop.

'471 suggests that the hand-held cleaner be battery operated using rechargeable batteries. In this case, if the hand-held cleaner is to be recharged through the upright cleaner, it is necessary to keep the upright cleaner plugged into the mains, even when stored.

Suction cleaners of the type having a motor-fan unit which causes an air flow through the inlet opening into the dust container and through the filter to atmosphere whereby dirt carried by the air flow is separated from the air flow and retained in the dust container by the filter are well known. Such cleaners exist in several forms, for example, as a conventional so-called canister cleaner, that is a suction cleaner where the inlet opening is disposed at the end of a hose, the other end of which is connected to a separate housing containing the motor fan unit and the dust container. Another form of suction cleaner is an upright cleaner, that is a suction cleaner where the inlet opening, the dust container, the motor fan unit and the handle are combined into one unit. Smaller hand-held units are also known which, in some cases, include rotating brushes in the inlet opening. The hand-held units are often powered by rechargeable batteries, but mains power units are also quite common.

Hand-held units are used because they are easy to handle, particularly when carrying out temporary or very brief cleaning work to collect dust, crumbs, spilled liquids or the like from a surface. These hand-held cleaners are usually emptied by removing the dust container, sometimes together with the filter, from the housing, after which the filter is separated from the dust container and the collected dirt is emptied into a waste bin before the filter and the dust container are reassembled. Since the dust container has a small volume, usually in the range of 0.5 to 10 dl, it must be emptied quite often if the vacuum cleaner is used regularly, which means a cumbersome and dirty task.

A suction cleaner according to a first aspect of the invention comprises a primary cleaner including an air channel and a fan for sucking air and dust into the primary cleaner via the air channel; and a wheel-less, hand-held auxiliary cleaner for above-the-floor cleaning, the auxiliary cleaner having a dust collection chamber and being attachable to the primary cleaner in such a manner that the dust collection chamber of the auxiliary cleaner is in communication with the primary cleaner via the air channel whereby dust within the dust collection chamber is drawn into the air channel of the primary cleaner for collection.

This allows cleaners to be manufactured having an auxiliary cleaner which an operator does not need to empty separately from the primary cleaner.

In this context, a hand-held cleaner is a unit which is lightweight and small in size when compared with an upright-type cleaner or 'cylinder-type' cleaner. The hand-held cleaner is used for cleaning upholstery, curtains, car interiors, stairs and the like.

The auxiliary cleaner preferably includes a valve for retaining dust within the dust collection chamber, and the primary cleaner preferably includes means for opening the valve when the auxiliary cleaner is attached to the primary cleaner. The opening means would typically be a spigot disposed in the air channel for pushing the valve open when the auxiliary cleaner is attached to the primary cleaner. The dust, is therefore, released from the dust collection chamber when the auxiliary cleaner is attached to the primary cleaner.

A particularly useful feature which may be incorporated is the inclusion of a second port opening into the dust collection chamber of the auxiliary cleaner such that, when the cleaner is used as an upright cleaner, the dust collection chamber forms part of the air channel, and all dust collected by the upright cleaner passes through the dust collection chamber before being collected in the primary cleaner.

Advantageously, the primary cleaner includes a collection receptacle disposed between the air channel and the fan. This permits an operator to empty dust collected by both the primary cleaner and the auxiliary cleaner from a single collection receptacle which is typically a disposable collection bag.

Conveniently, the auxiliary cleaner includes a handle which, when the auxiliary cleaner is attached to the primary cleaner, constitutes a handle for the primary cleaner, so that the same handle is used for both the primary cleaner and the auxiliary cleaner, thus saving material costs and resulting in compact storage of the auxiliary cleaner.

According to a preferred embodiment of the present invention, the primary cleaner includes a power receiving terminal, and the auxiliary cleaner includes a power source for supplying power to the auxiliary cleaner and a power supplying terminal connectable to the power receiving terminal of the primary cleaner when the auxiliary cleaner. is attached thereto.

The power source may be a power supply cable, a socket for receiving a power supply cable, or a rechargeable battery. In each of these cases, the auxiliary cleaner may be used without any restriction caused by the primary cleaner. The auxiliary cleaner preferably includes a power transfer device for delivering power from the power source to the primary cleaner alone when the auxiliary cleaner is attached to the primary cleaner. This means that only a single power supply is required to operate both the primary and auxiliary cleaners. Normally, the transfer device is operable to deliver power from the power source to the auxiliary alone when the auxiliary cleaner is not attached to the primary cleaner. A common switch can then be used to operate both the primary and auxiliary cleaners.

A suction cleaner according to a second aspect of the invention comprises a primary cleaner including a body, an air channel and a fan for sucking air and dust into the primary cleaner via the air channel, and an auxiliary cleaner having a dust collection chamber, the auxiliary cleaner being mountable on the body of the primary cleaner in such a manner that the dust collection chamber of the auxiliary cleaner is in communication with the primary cleaner via the air channel whereby, in use, dust within the dust collection chamber is drawn into the air channel of the primary cleaner for collection.

Such a cleaner is compact, and where the primary cleaner is an upright cleaner, the functions of the primary and auxiliary cleaners compliment each other. It would also be cheaper for a consumer to buy the above type of cleaner than separate primary and auxiliary cleaners.

The various advantageous features described above in connection with the first aspect of the invention also apply to the second aspect.

According to a third aspect of the invention, a suction cleaner comprises a housing having a dust container and a filter, the dust container being connected to an inlet opening and to a motor-fan unit such that operation of the motor-fan unit creates an air flow via the inlet opening into the dust container and through the filter to atmosphere, whereby dirt carried by the air flow is separated from the air flow and retained in the dust container by the filter, the cleaner including an emptying opening for attachment to a vacuum source wherein, the suction cleaner is arranged such that, during emptying, the dirt is carried through the emptying opening in a stream of air entering the dust container via at least one of the inlet opening and the motor-fan unit. This aspect of the invention is particularly applicable to hand-held cleaners, although it is not restricted to such cleaners.

Several forms of suction cleaner, each of which is constructed in accordance with the invention, will now be described, by way of example, with reference to the accompanying drawings, in which.

Figure 1:
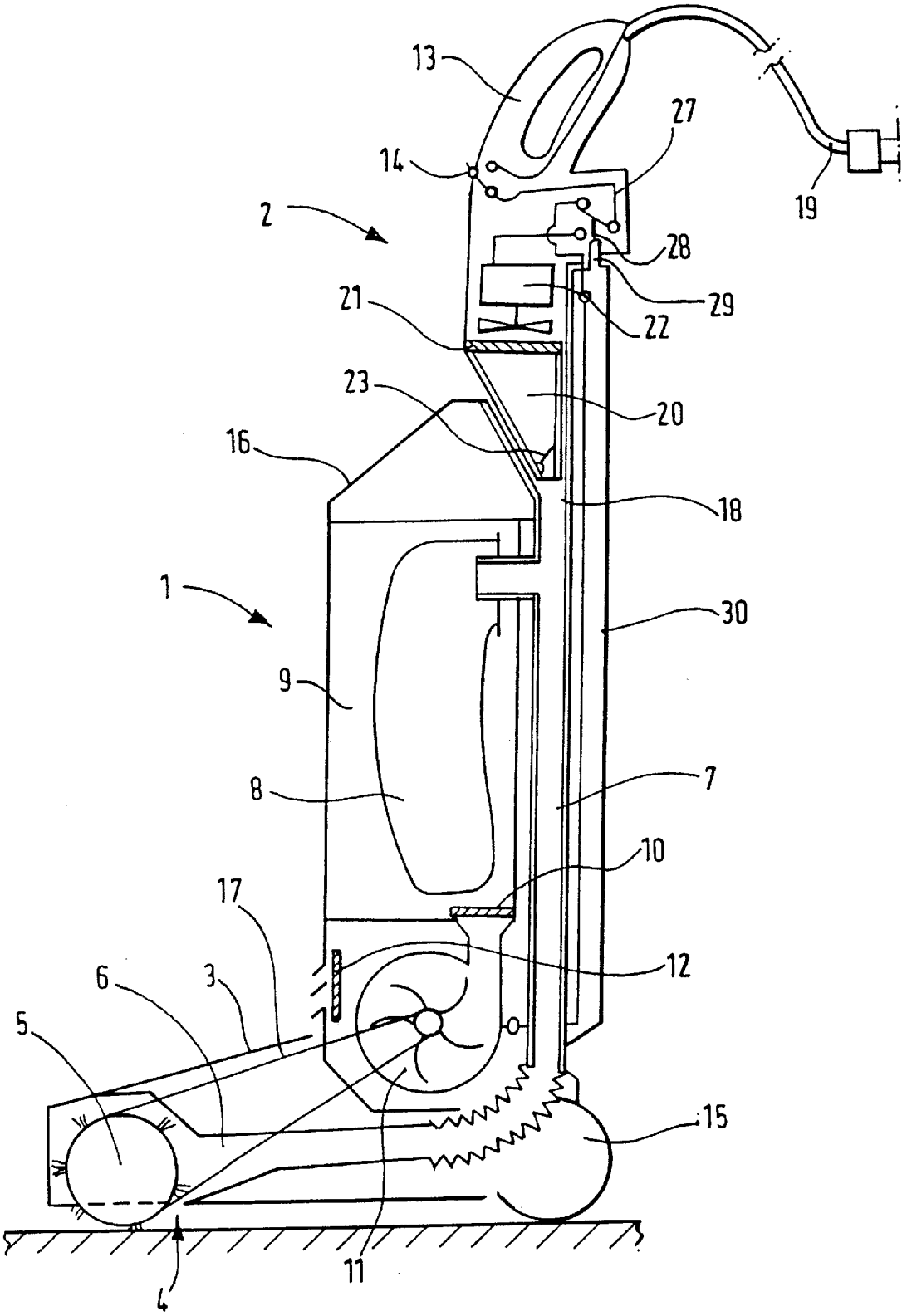
FIG. 1 is a schematic sectional view of a first form of suction cleaner which is constituted by an upright cleaner and a hand-held cleaner.

Referring to FIG. 1, the suction cleaner includes an upright suction cleaner 1 and a hand-held, wheel-less auxiliary suction cleaner 2 attached to the upright cleaner. The hand-held cleaner 2 includes a handle 13 which also forms the handle of the upright cleaner 1.

When the hand-held cleaner 2 is attached to the upright cleaner 1, as shown in FIG. 1, the upright cleaner may be used in substantially the same way as a conventional cleaner.

A switch 14, disposed on the hand-held cleaner 2 adjacent to the handle 13, controls operation of the upright cleaner 1 when the hand-held cleaner is attached, and controls operation of the hand-held cleaner when detached. A power cable 19 extends from the hand-held cleaner 2. An advantage of this cleaner is that only a single handle, a single switch and single power cable are required, thus keeping manufacturing costs down, and keeping operation of the cleaner simple.

When the hand-held cleaner 2 is detached from the upright cleaner 1, the hand-held cleaner may be used to clean stairs, chairs, curtains, floor edging, car interiors and the like.

The upright cleaner 1 includes a base unit 3 having ground wheels or rollers 15, a suction opening 4 confronting the floor to be cleaned, a rotary beater 5 disposed in the suction opening for beating the region of the floor confronting the suction opening in order to dislodge dust and the like, and a first air duct 6 through which dust is drawn from the suction opening.

A rigid, upright body 16 is pivotally mounted on the base unit 3. When the upright body 16 is disposed in a substantially vertical position as shown in FIG. 1, the upright body is latched for storage. In use, the upright body 16 is reclined so that the base unit 3 may be pushed along the floor. The upright body 16 includes a second air duct 7 which is connected to the first air duct 6, and through which dust is sucked from the first air duct. The second air duct 7 delivers the dust-laden air into an air permeable dust collection bag 8 disposed within a dust compartment 9. The upright body 16 also includes a suction fan 11 and a motor (not shown) for driving the suction fan. The suction fan 11 sucks air from the dust compartment 9 through a first filter 10, and exhausts air to atmosphere via a second filter 12. The motor also drives the rotary beater 5 through a drive belt 17. The first air duct 6, the second air duct 7, and the dust compartment 9 are all disposed at the low pressure side of the suction fan 11, and together constitute an air channel through which air sucked by the fan passes.

The second air duct 7 includes a port 18 which opens to atmosphere and which is shaped to receive the auxiliary hand-held cleaner 2 with an air tight seal. Thus, air cannot enter the second duct 7 from the atmosphere between the surface of the port 18 and the hand-held cleaner 2 while the upright cleaner 1 is in use. The upright body 16 further includes a support 30 on which the hand-held auxiliary cleaner 2 is supported. The support 30 includes a finger 29 which engages with the hand-held auxiliary cleaner 2 when carried on the upright cleaner 1 to support and assist in locating the hand-held cleaner on the upright cleaner.

The hand-held auxiliary cleaner 2 includes a dust collection mouth 31 through which dust is drawn, a dust collection chamber 20 for collecting the dust, a fan and motor unit 22 for generating suction, and a dust filter 21, disposed between the dust collection chamber and the fan and motor unit for retaining dust within the dust collection chamber.

The hand-held cleaner 2 includes a valve 23 disposed in the collection mouth 31 for retaining dust within the dust collection chamber 20 when the hand-held cleaner is held upright with the collection mouth lowermost. The valve 23 is a flap which is pivotally mounted for movement about a fulcrum 25 (see FIG. 2), and is biassed towards a closed position closing the collection mouth. When the fan and motor unit 22 is switched on, the suction generated opens the valve 23 so that dust may be collected.

Figure 2:
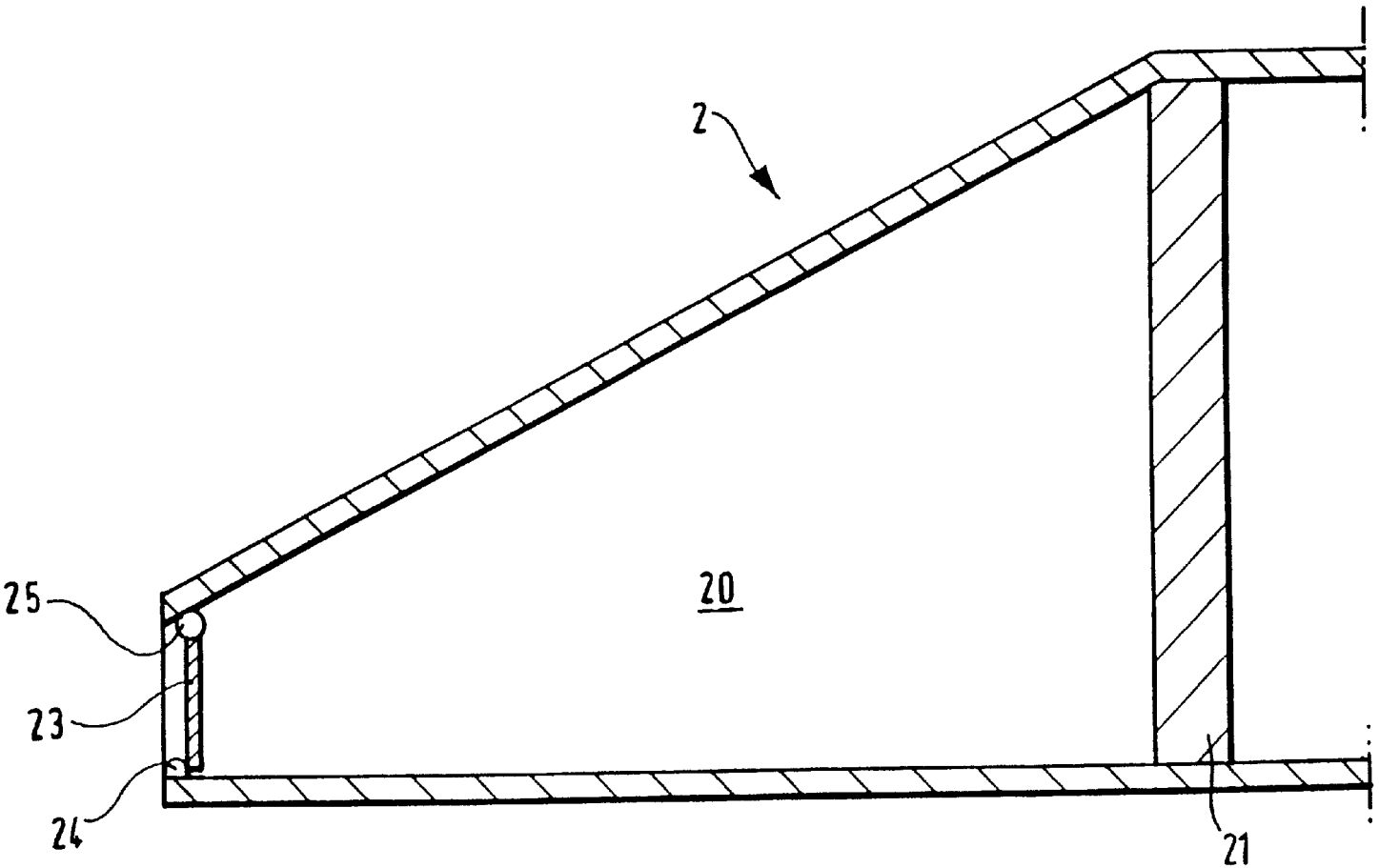
FIG. 2 is a sectional view of part of the hand-held cleaner of FIG. 1.
Figure 3:
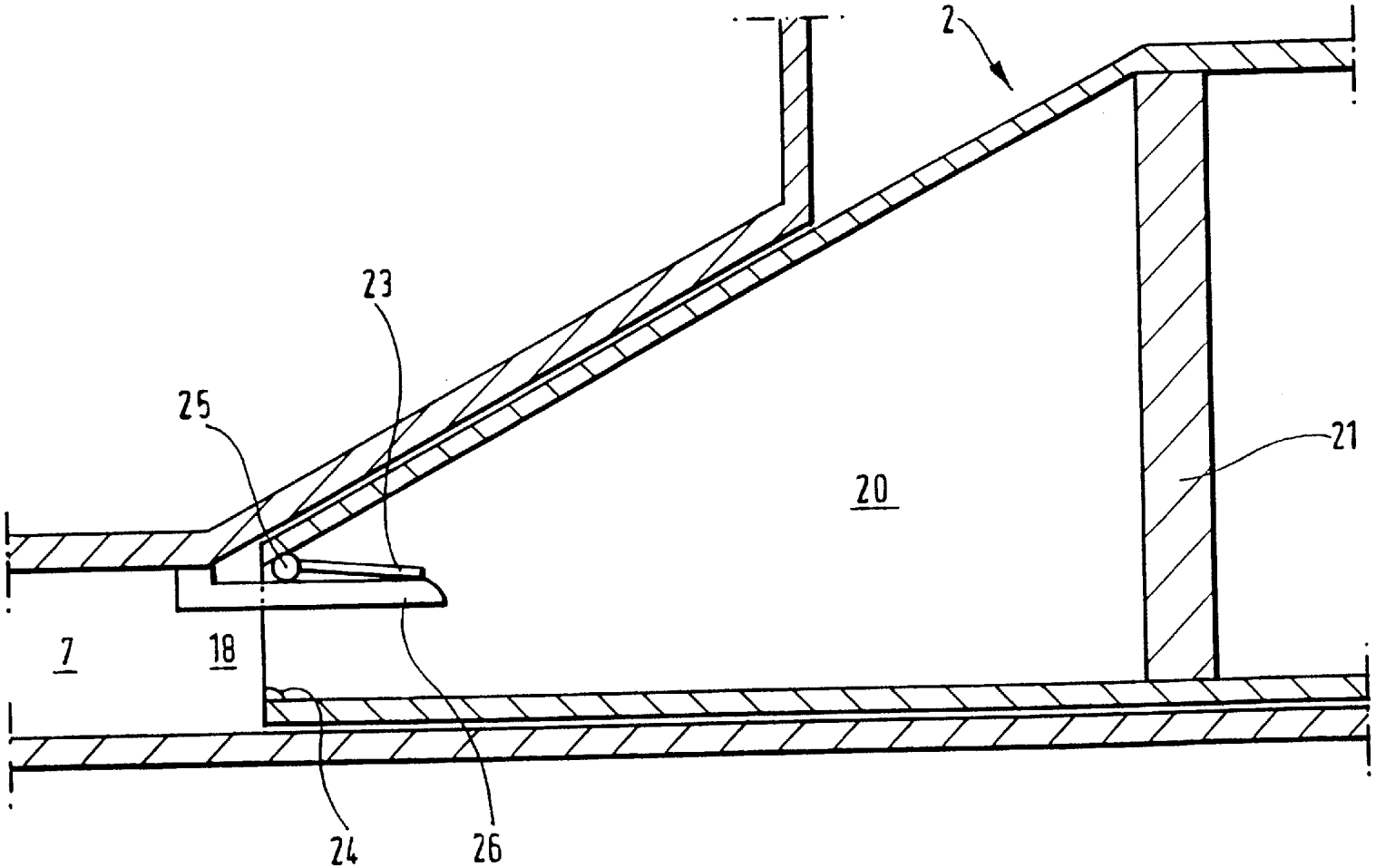
FIG. 3 is a sectional view of part of the hand-held cleaner of FIG. 1 attached to the upright cleaner.

The collection mouth 31 of the hand-held cleaner 2 and the valve 23 arrangement are shown in more detail in FIGS. 2 and 3. FIG. 2 shows an end of the hand-held cleaner 2 separated from the upright cleaner 1 but not switched on. The valve 23 is, therefore, in a closed position against a stop 24.

FIG. 3 shows the hand-held cleaner 2 inserted into the port 18 of the upright cleaner 1. The port 18 includes a spigot 26 which extends into the port. When the hand-held cleaner 2 is inserted into the port 18, the spigot 26 passes through the collection mouth 31 to deflect the valve 23 against the bias into its open position. Dust held within the dust collection chamber 20 is then released to fall into the duct 7 of the upright cleaner 1.

The next time that the upright cleaner 1 is used, the dust which has fallen into the duct 7, and any remaining dust within the dust collection chamber 20 is sucked into the dust collection bag 8 within the dust compartment 9 of the upright cleaner. It is, therefore, unnecessary to empty the hand-held cleaner 2 separately from the dust collection bag 8 of the upright cleaner. Furthermore, the hand-held cleaner 2 has no permanent connection with the upright cleaner 1, and so it may be used fully independently of the upright cleaner.

In the embodiment shown in FIG. 1, the power cable 19 is connected to the hand-held unit 2. The cable 19 passes power through the switch 14 before reaching a power transfer unit 27. The power transfer unit 27 connects mains power either to the fan and motor unit 22 within the hand-held cleaner 2 when the hand-held cleaner is removed from the upright cleaner 1, or to the upright cleaner when the hand-held cleaner is attached to the upright cleaner.

The power transfer unit 27 includes a microswitch 28 which is closed by the finger 29 extending from the support 30 of the upright cleaner 1. When the microswitch 28 is closed, the power transfer unit 27 directs power to the upright cleaner 1 through a set of contacts (not shown) similar to those found on cordless kettles.

An advantage of the arrangement shown in FIG. 1 is that a powerful mains powered motor may be used in the hand-held cleaner 2 without the necessity for bulky and heavy batteries.

The hand-held cleaner 2 and the upright cleaner 1 each include corresponding parts (not shown) of a latching mechanism for holding the hand-held cleaner 2 securely on the upright cleaner 1. A release button might be included on either cleaner 1, 2 for releasing the latching mechanism.

Cleaning tools (not shown) are intended to be sold with a suction cleaner of the type described. For example, a crevice tool may be attached to the collection mouth 31 of the hand-held cleaner 2. Such tools may be carried on the body of the upright cleaner 1.

In a modified version of this cleaner, the hand-held cleaner 2 could be powered by a re-chargeable battery, in which case only the upright cleaner 1 would be mains powered through a mains power cable. In this case, the upright cleaner 1 would include a recharger base unit which, when the hand-held cleaner 2 is carried by the upright cleaner, connects to the rechargeable battery in order to recharge it. Alternatively, the recharger base unit may be separate from the upright cleaner 1 so that recharging may take place near a mains socket.

Figure 4:
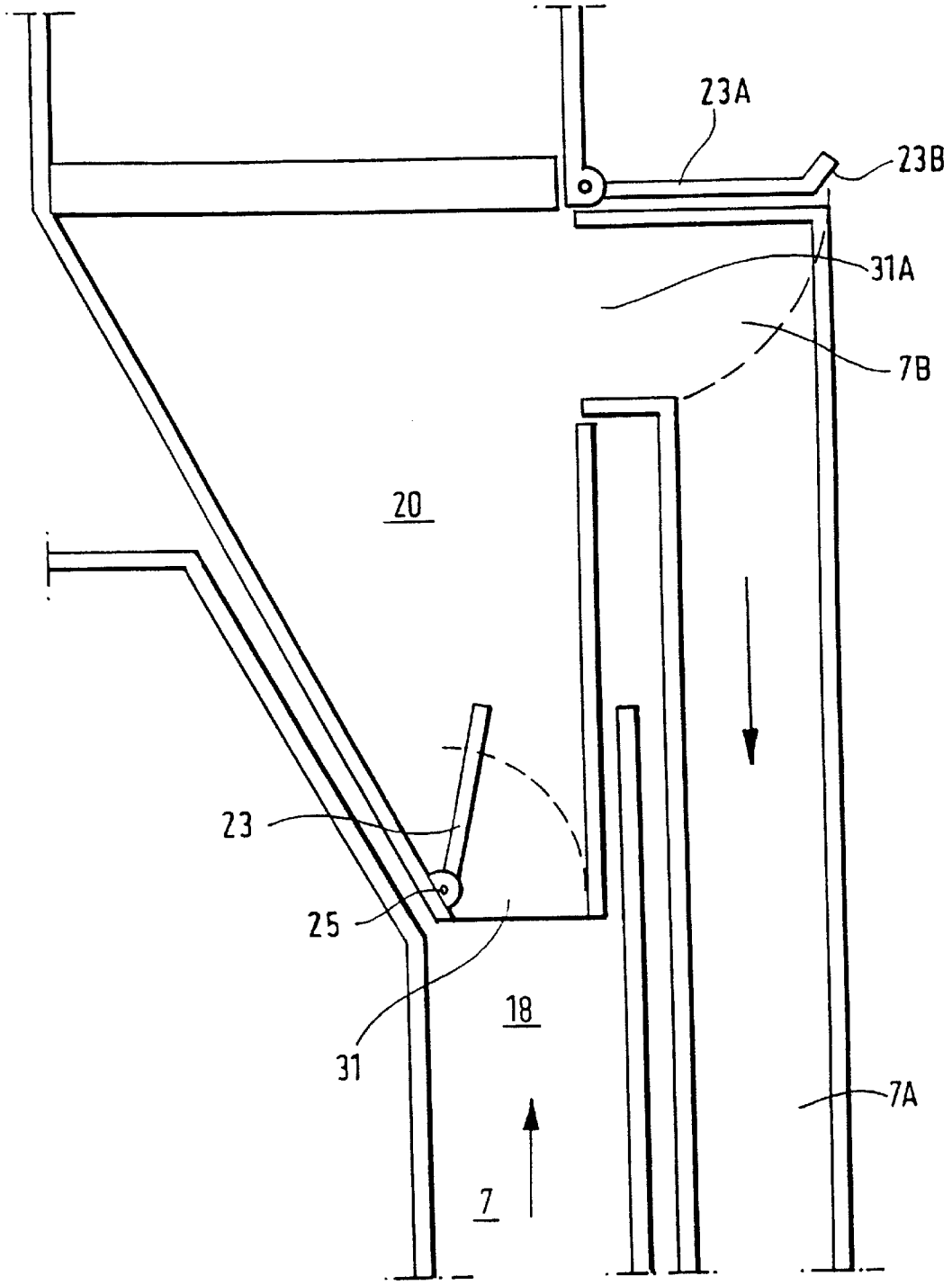
FIG. 4 is a sectional view of a modified version of the first form of suction cleaner, in which a hand-held cleaner is attached to an upright cleaner.

FIG. 4 shows part of a modified cleaner of the type shown in FIGS. 1 to 3. As this cleaner is configured in substantially the same way as that shown in FIGS. 1 to 3, like reference numerals will be used for like parts and only the modifications will be described in detail.

The second air duct 7 does not lead directly to the dust collection bag (not shown), but does include a port 18 into which the hand-held cleaner 2 is inserted. The upright cleaner 1 includes a third air duct 7A which leads to the dust collection bag.

The hand-held cleaner 2 includes a collection mouth 31 similar to that shown in FIGS. 1 to 3, with a valve 23 pivotable about a fulcrum 25 and biassed towards the collection mouth 31 so as to close the mouth. As will become clear below, a spigot is not required to open the valve 23.

The dust collection chamber 20 includes a second port 31A and a second valve 23A which is able to close the second port. The second valve 23A is biassed towards its closed position, and includes a lip 23B. As the hand-held cleaner 2 is inserted into the port 18 of the upright cleaner 1, the lip 23B of the second valve 23A engages with the body of the upright cleaner and is opened. The third air duct 7A of the upright cleaner 1 includes an inlet 7B which, when the hand-held cleaner 2 is fully inserted in the port 18 of the upright cleaner 1, is aligned with the open second port 31A of the hand-held cleaner 2. Thus, the dust collection chamber 20 of the hand-held cleaner 2 forms part of the air channel of the upright cleaner 1. When the upright cleaner 1 is switched on, the fan (not shown) draws air and dust from the suction opening of the base unit (not shown) of the upright cleaner through the first air duct (not shown) into the second air duct 7. The flow of air deflects the valve 23 of the hand-held cleaner 2 into its open position, and the dust laden air passes into the dust collection chamber 20 of the hand-held cleaner. The air carries the dust from the suction opening of the base unit and any dust already collected in the dust collection chamber 20 of the hand-held cleaner 2 through the second port 31A into the third air duct 7A, and thence into the dust collection bag disposed within the dust compartment of the upright cleaner 1.

When the hand-held cleaner 2 is removed from the upright cleaner 1, the second valve 23A closes the second port 31A so that the cleaner can be used in the same way as is described in connection with the cleaner of FIGS. 1 to 3.

Figure 5:
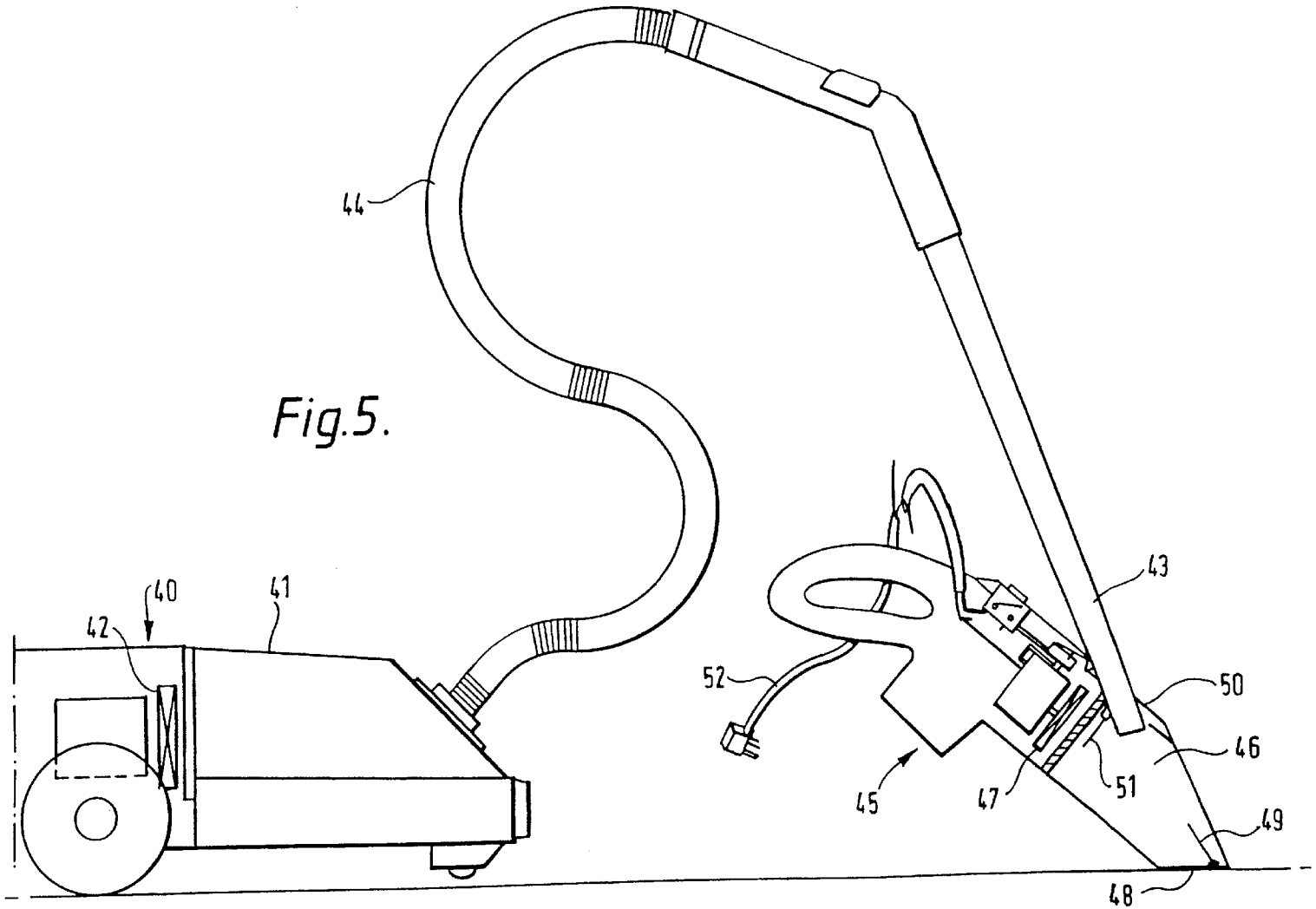
FIG. 5 is a schematic view of a second form of suction cleaner, in which the primary cleaner is a cylinder-type cleaner.

FIG. 5 shows the second form of suction cleaner, in which the primary cleaner is a cylinder-type cleaner. In this specification, the term "cylinder-type cleaner" refers to a suction cleaner of the type including a body and a collection hose extending from the body, an end of the hose remote from the body being used for cleaning. The cylinder-type cleaner 40 shown in FIG. 5 has a body 41, a fan unit 42 disposed in the body and a collection hose 44 for leading dust into the body for collection. A nozzle 43 is disposed at the end of the hose 44 remote from the cleaner 40. A hand-held cleaner 45 is attachable to the nozzle 43 of the hose 44. The hand-held cleaner 45 includes a dust collection chamber 46, a fan unit 47, a collection mouth 48 and a valve 49 disposed in the collection mouth for retaining dust in the collection chamber 46. A port 50 opens into the collection chamber 46 for entry of the nozzle 43 into the collection chamber. When the nozzle 43 is removed from the port 50, a flap 51 closes the port. The hand-held cleaner 45 includes a mains lead 52 so that, when disconnected from the nozzle 43, it may be used independently for cleaning stairs and the like. The fan unit 47 draws dust laden air through the collection mouth 48 into the collection chamber 46 where the dust is collected.

The cylinder-type cleaner 40 may be used independently of the hand-held cleaner 45, or the hand-held cleaner may be attached to the nozzle 43 so that the hand-held cleaner acts as a cleaning tool. Dust laden air may then be sucked through the hand-held cleaner 45, and any dust already collected by the hand-held cleaner is sucked into the cylinder-type cleaner 40 for central collection. When the hand-held cleaner 45 is attached to the cylinder type cleaner 40, the fan unit 42 in the cylinder type cleaner is used alone to collect dust.

Figure 6:
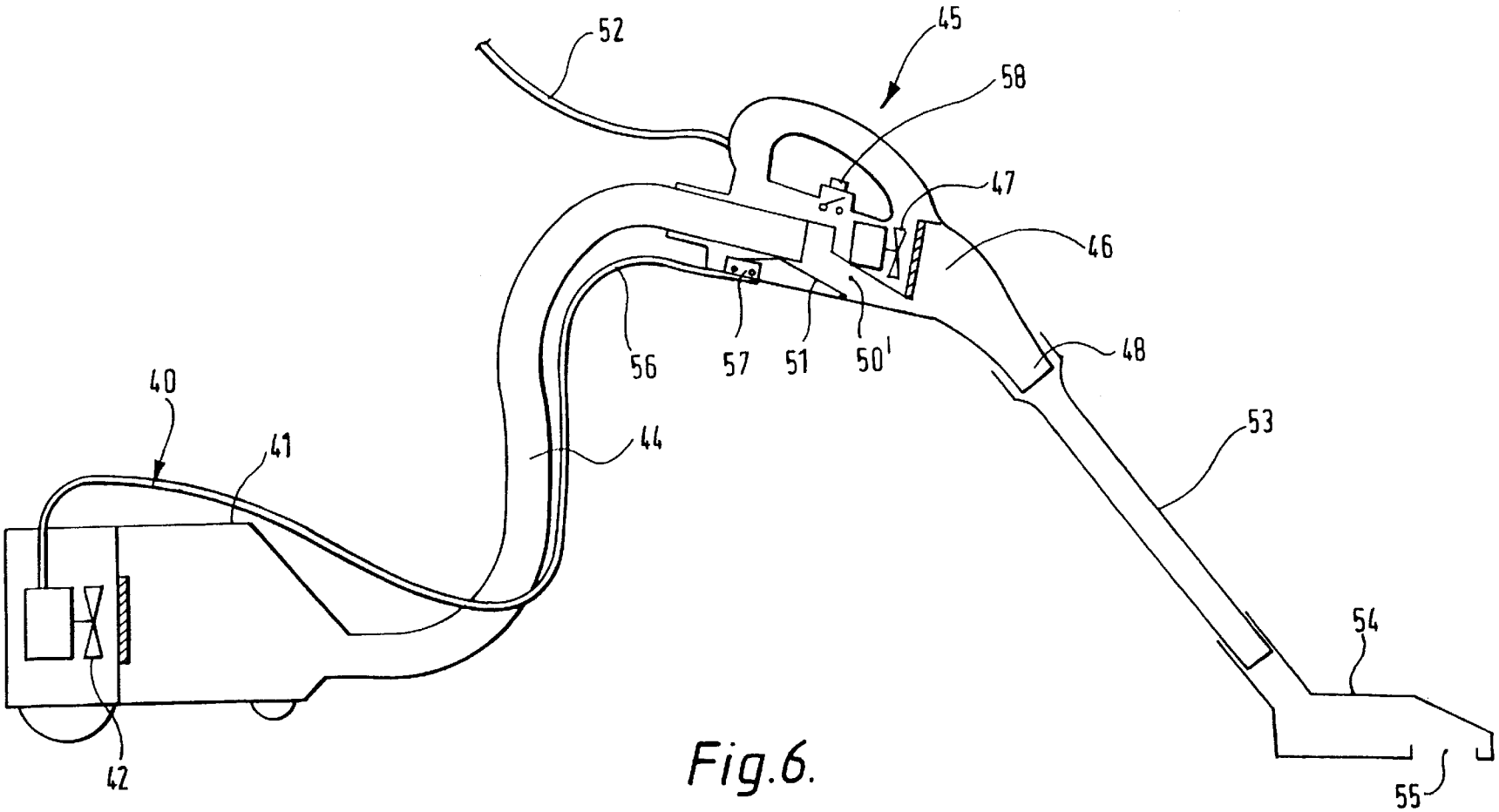
FIG. 6 is a schematic view of a third form of suction cleaner, in which the primary cleaner is a cylinder-type cleaner.

FIG. 6 shows the third form of suction cleaner. This cleaner is similar to the cleaner of FIG. 5, so like reference numerals will be used for like parts, and only the modifications will be described in detail. Thus, the hand-held cleaner 45 is attachable directly to the collection hose 44 at an end remote from the cylinder-type cleaner 40. Moreover, a passage 50' opens into the hand-held cleaner 45, the passage being in communication with the dust collection chamber 46. When the collection hose 44 is removed from the passage 50', it is closed by the flap 51.

The hand-held cleaner 45 includes a switch 58 for operation of the fan unit 47. The auxiliary cleaner 45 also includes a power transfer unit 57 which, when the auxiliary cleaner 45 is attached to the collection hose 45 of the primary cleaner 40 connects mains power to the primary cleaner. The switch 58 is closed when the collection hose 46 is inserted into the passage 50' of the auxiliary cleaner 45. The primary cleaner 40 includes a power cord 56 which follows the collection hose 45 to connect the fan unit 42 of the primary cleaner 40 to the power transfer unit 57 of the auxiliary cleaner 45. In this way, when the primary cleaner 40 is to be used, the auxiliary cleaner 45 must be attached to the collection hose 44, and the primary cleaner is controlled by the switch 58 disposed on the auxiliary cleaner. Upon activation of the switch 58, the fan unit 42 is operated to suck dust through the collection mouth 48 of the auxiliary cleaner 45, through the auxiliary cleaner and through the collection hose 44. Furthermore, during this mode of operation, any debris collected within the collection chamber 46 is sucked into the primary cleaner 40 via the passage 50' and the collection hose 44. In this mode of operation, the fan unit 47 within the auxiliary cleaner 45 is not operated. The auxiliary cleaner 45, therefore, acts as a cleaning tool and as a handle of the primary cleaner 40. For convenience, the switch 58 operates the primary cleaner 40. Dust laden air may then be sucked through the hand-held cleaner 45.

Various tools may be attached to the hand-held cleaners 45 of FIGS. 5 and 6. Thus, as shown in FIG. 5, a rigid extension tube 53 is attachable to the collection mouth 48 of the hand-held cleaner 45 by pushing a flared end of the extension tube over the collection mouth. A floor-engaging tool 54 is attached to the opposite end of the extension tube 53, the floor engaging tool having a suction opening 55 which is suitable for applying suction to a floor. A rotatable brush (not shown) may be located in the suction opening 55 for disturbing dust from the area of the floor confronting the suction opening. Such a brush might be powered by a turbine driven by the airflow passing through the floor engaging tool 54.

The hand-held auxiliary cleaner 45 is attachable to the body 41 of the primary cleaner 40. The handle of the hand-held cleaner 45 then forms the handle of the body.

Figure 7:
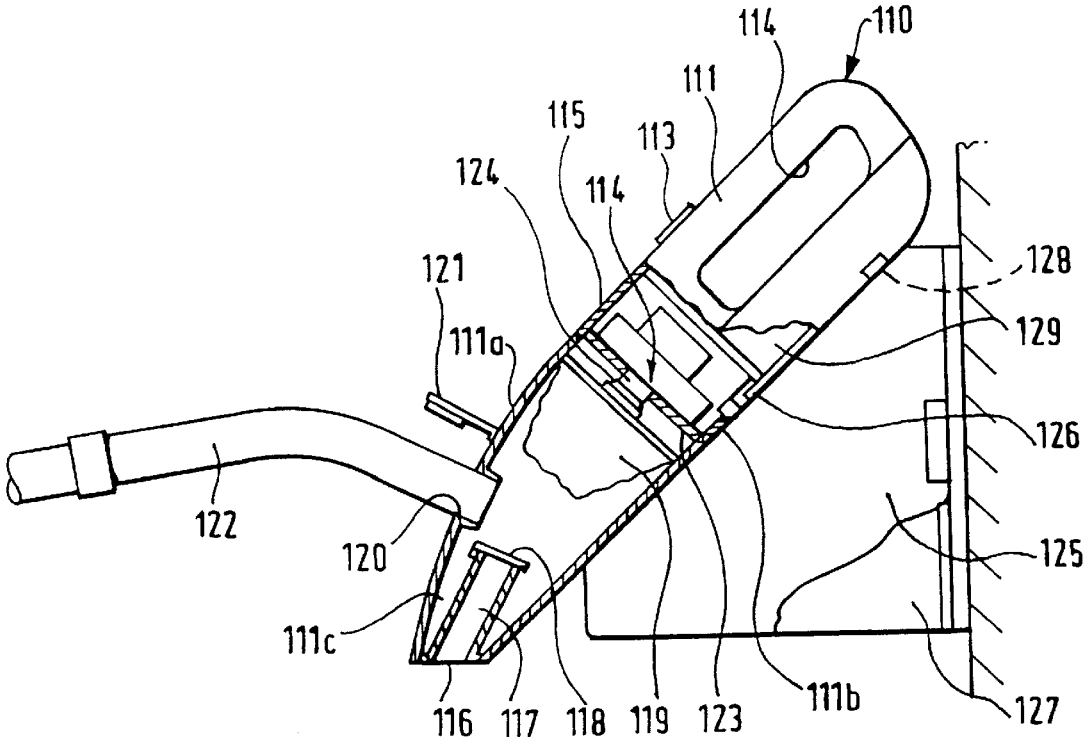
FIG. 7 is a vertical section through a fourth form of suction cleaner which is a hand-held cleaner carried on a carrier which is mounted on a wall.

A shown in FIG. 7, the battery-powered suction cleaner 110 comprises a housing 111 consisting of front and rear parts 111*a* and 111*b* respectively. The rear part 111*b* encloses a motor-fan unit 112 which, via electrical conductors (not shown) and various electronic components are controlled by a switch 113 positioned adjacent a handle 114 disposed on the housing 111. The outlet side of the fan, which is part of the motor-fan unit 112 communicates via openings 115 in the housing 111 with the atmosphere.

The front part 111*a* of the housing is shaped to form a container 111*c* in which dirt particles are collected, and can be removed from the rear part 111*b* in a manner not shown. The front part 111*a* includes a nozzle having an inlet opening 116 and a tube 117 leading into the body of the container 111*c* from the inlet opening 416. The inner end of the tube 117 is closed by a flap 118, preferably of rubber, one edge of which is fixed close to the inner end of the tube 117 so that the flap 118 can serve as a check valve. The front part 111*a* also supports a filter 119 for separating particles of dirt from the air which flows through the container 111*c*, this filter being removable from the front part 111*a* when the front and rear parts 111*a*, 111*b* have been separated from each other. Alternatively, the filter could instead be fastened to the rear part 111*b*. The front part 111*a* also has an emptying opening 120 which is normally closed by a cover 121 pivotally fastened to the outside of the front part 111*a*. The opening 120 has a shape such that a tubular nozzle 122 or other accessory belonging to a separate suction cleaner, not shown, can be connected to the emptying opening 120. Preferably the emptying opening is shaped with a truncated conical sleeve or flange so that nozzles of different sizes can be connected to the emptying opening.

The front and rear parts 111*a* and 111*b* are separated by a partition wall 123 having a central inlet part 124 through which the air flows from the container 111*c* to the fan in the motor-fan unit 112.

Battery-powered hand-held suction cleaners are normally stored on a carrier such as is shown in the drawing. The carrier 125 includes a hook 126 and includes a battery charger 127 which is connected to a mains power socket and transmits charging energy via electrical contact means 128 to a battery 129 disposed within the rear part 111*b* of the suction cleaner.

The device shown in FIG. 7 operates as follows. The suction cleaner 110 is removed from the carrier 125, and the cover 121 is closed in its normal position over the emptying opening 120. The-motor fan unit 112 is activated by the switch, 113 in order to generate a flow of air. The air is sucked through the inlet opening 116 and the tube 117 thereby lifting the flap 118. The particles of dirt which are sucked into the container 111*c* are separated by the filter 119 and fall into the bottom of the container 111*c*, that is, the area around the tube 117 which is normally at the bottom of the container 111*c*, particularly when the cleaner 110 is disposed on the carrier 125. The clean air flows through the inlet part 124 to the fan, after which it is blown to atmosphere through the openings 115. When cleaning has been finished, the cleaner is replaced on the carrier 125.

At a suitable time during the normal cleaning work in a household during which the floors and carpets are cleaned by a large vacuum cleaner, the cover 121 is opened, and the nozzle 122 of the large vacuum cleaner is connected to the emptying opening 120. The dirt which is present in the container 111*c* will be sucked out through the nozzle 122 and into the dust bag of the large vacuum cleaner. Since the volume of the dust bag in the large vacuum cleaner is several times larger than the volume of the container 111*c* in the battery powered hand-held suction cleaner 110, the dirt which is transferred will not cause any significant change in volume of collected dirt in the dust bag. At the same time as the dirt is sucked from the container 111*c*, air will flow backwards through the openings 115, the fan, the inlet part 124 and through the filter 119 which means that dirt particles which are stuck to the filter will be entrained by the stream of air. This means that a simultaneous cleaning of the filter is effected. In addition, some air will be drawn into the container 111*c* via the inlet opening 116.

Figure 8:
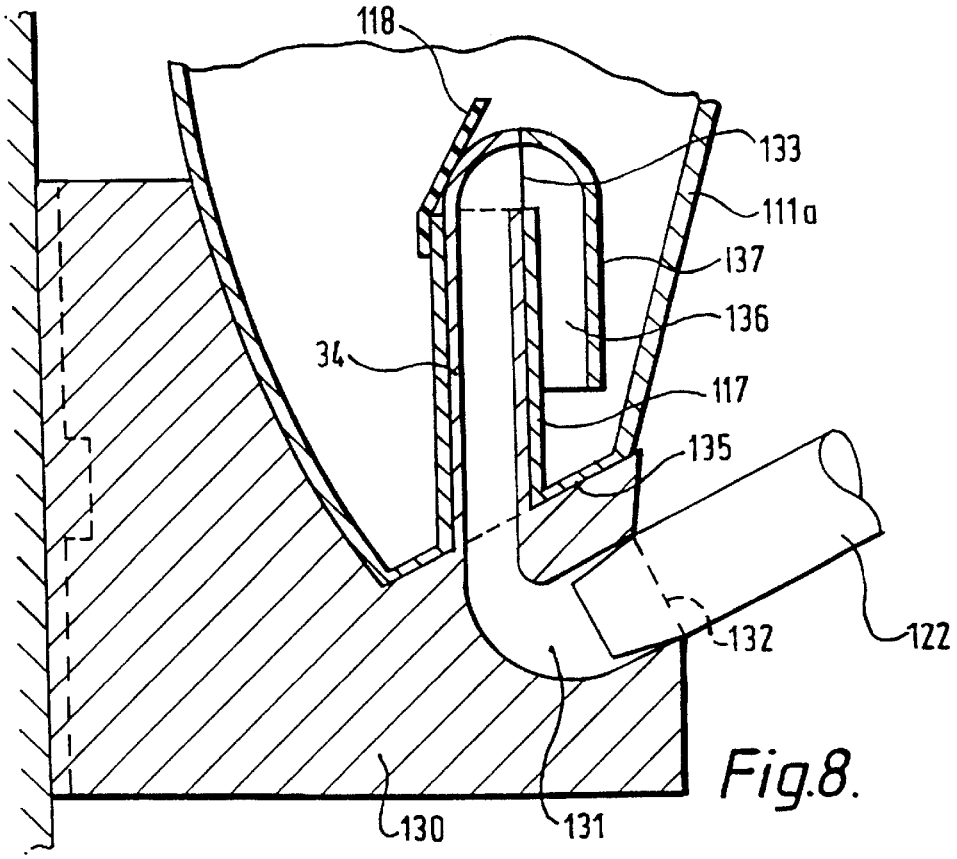
FIG. 8 is a vertical section through the lower part of a fifth form of cleaner which is a hand-held suction cleaner supported in a particular type of carrier.

Referring now to FIG. 8, the device differs somewhat from the above embodiment, in that emptying does not take place completely separately from the inlet opening 116. Also, the carrier 130 includes a channel 131 which includes a channel pipe 134 extending outwardly beyond an abutment surface 135 against which the tip of the front part 111*a* and the inlet opening 116 of the suction cleaner rest when it is placed on the carrier 130. When the suction cleaner is carried by the carrier 130, the channel pipe 134 is surrounded by the tube 117 leading into the container and is long enough that it lifts the flap 118 from the end of the tube 117. The end of the channel pipe 134 is preferably curved to one side so that its channel inlet 133 is disposed in a plane parallel with the longitudinal axis of the tube 117. The container includes a passage 136 which connects to the channel inlet 133 and extends downwards to the bottom of the container 111*c*. The passage 136 is formed against the outer wall of the tube 117 by a wall part 137.

The channel 131 also includes an outlet opening 132 which constitutes the emptying opening to which a vacuum source is connectable for emptying the dust collector 111*c*.

The device operates in the following manner. When the battery-powered suction cleaner 110 is placed on the carrier 130, the end of the channel pipe 134 lifts the flap 118 at the same time as the channel inlet 133 connects with the upper end of the passage 136 disposed within the container 111*c*. During normal household cleaning, the nozzle 122 of a large suction cleaner is coupled to the emptying opening 132 in the way described above, so that dirt in the dust container 111*c* will be sucked out through the passage 136, and the channel 131 to the dust bag of the large suction cleaner.

It should also be mentioned that the invention can also be used when emptying canister cleaners and upright suction cleaners by connecting the emptying opening of the suction cleaner to a vacuum source, such as a central suction cleaner. The central suction cleaner typically includes a large dust container and a fan unit located at a separate position, usually outside the living area, and a hose with a nozzle can be connected to the fan unit by means of a pipe system installed within the house or apartment.

What is claimed is:

1. A suction cleaning apparatus comprising:

a primary cleaner including an air channel and a fan for sucking air and dust into the primary cleaner via the air channel; and a wheel-less, hand-held auxiliary cleaner for above-the-floor cleaning, the auxiliary cleaner having a dust collection chamber and an auxiliary fan unit, wherein the auxiliary cleaner is connectable to the primary cleaner in such a manner that the dust collection chamber of the auxiliary cleaner is in communication with the primary cleaner via the air channel whereby, when connected to the primary cleaner during use of the primary cleaner, dust within the dust collection chamber is drawn into the air channel of the primary cleaner for collection.

2. A suction cleaner according to claim 1, wherein the primary cleaner includes a body, and the auxiliary cleaner is mounted on the body of the primary cleaner to attach it to the primary cleaner.

3. A suction cleaner according to claim 1, wherein the auxiliary cleaner includes an access port opening into the dust collection chamber, and a valve for closing the port to retain dust within the dust collection chamber, the valve being operable to permit dust within the dust collection chamber to pass through the access port for collection within the primary cleaner.

4. A suction cleaner according to claim 3, wherein the access port constitutes a collection inlet through which dust is collected into the dust collection chamber.

5. A suction cleaner according to claim 3, wherein the auxiliary cleaner further includes a collection inlet through which dust is drawn by the auxiliary cleaner, the collection inlet being separate from the access port.

6. A suction cleaner according to claim 5, wherein, when the auxiliary cleaner is connected to the primary cleaner, the collection chamber of the auxiliary cleaner constitutes part of the air channel.

7. A suction cleaner according to claim 6, wherein the primary cleaner includes a collection opening at an upstream end of the air channel, and the collection chamber of the auxiliary cleaner constitutes a part of the air channel downstream of the collection opening.

8. A suction cleaner according to claim 5, wherein the auxiliary cleaner includes an openable closure for closing the collection inlet.

9. A suction cleaner according to claim 3, wherein the primary cleaner includes means for opening the valve when the auxiliary cleaner is attached to the primary cleaner.

10. A suction cleaner according to claim 9, wherein the means for opening the valve is a spigot disposed in the air channel for pushing the valve open when the auxiliary cleaner is attached to the primary cleaner.

11. A suction cleaner according to claim 9, wherein the means for opening the valve is an end of the air channel for pushing the valve open when the auxiliary cleaner is attached to the primary cleaner.

12. A suction cleaner according to claim 1, wherein the primary cleaner includes a collection receptacle disposed between the air channel and the suction fan.

13. A suction cleaner according to claim 1, wherein the auxiliary cleaner includes a handle which, when the auxiliary cleaner is connected to the primary cleaner, constitutes the handle of the primary cleaner.

14. A suction cleaner according to claim 1, wherein the primary cleaner includes a power receiving terminal, and the auxiliary cleaner includes a power source for supplying power to the primary cleaner, and a power supplying terminal connectable to the power receiving terminal of the primary cleaner when the auxiliary cleaner is attached thereto.

15. A suction cleaner according to claim 14, wherein the power source is a power supply cable.

16. A suction cleaner according to claim 14, wherein the power source is a socket for receiving a power supply cable.

17. A suction cleaner according to claim 14, wherein the auxiliary cleaner includes a power transfer device for delivering power from the power supply cable to the primary cleaner alone when the auxiliary cleaner is attached to the primary cleaner.

18. A suction cleaner according to claim 17, wherein the transfer device is operable to deliver power from the power supply cable to the auxiliary cleaner alone when the auxiliary cleaner is not attached to the primary cleaner.

19. A suction cleaner according to claim 14, wherein the power source includes a rechargeable battery.

20. A suction cleaner according to claim 19, including a recharger base unit to which the auxiliary cleaner is attachable.

21. A suction cleaner according to claim 1, including a switch for selectively controlling power to the primary cleaner and to the auxiliary cleaner.

22. A suction cleaner according to claim 1, wherein the auxiliary cleaner includes a switch for controlling power to the primary cleaner when the auxiliary cleaner is attached thereto, and for controlling power to the auxiliary cleaner when the auxiliary cleaner is not attached to the primary cleaner.

23. A suction cleaner according to claim 1, wherein the primary cleaner is an upright suction cleaner.

24. A suction cleaner according to claim 23, wherein the air channel includes a collection hose.

25. A suction cleaner according to claim 1, wherein the primary cleaner is a cylinder-type cleaner.

26. A suction cleaner according to claim 25, wherein the air channel includes a collection hose.

27. A suction cleaner according to claim 26, wherein the cylinder-type cleaner further includes a power cord disposed along the collection hose for conveying power to the cylinder cleaner from the auxiliary cleaner.

28. A suction cleaning apparatus comprising:

a primary cleaner including a body, an air channel and a fan for sucking air and dust into the primary cleaner via the air channel, and an auxiliary cleaner having a dust collection chamber and an auxiliary fan unit, wherein the auxiliary cleaner is connectable to the body of the primary cleaner in such a manner that the dust collection chamber of the auxiliary cleaner is in communication with the primary cleaner via the air channel whereby, when connected to the primary cleaner during use of the primary cleaner, dust within the dust collection chamber is drawn into the air channel of the primary cleaner for collection.

29. A suction cleaner according to claim 28, wherein the auxiliary cleaner includes an access port opening into the dust collection chamber, and a valve for closing the port to retain dust within the dust collection chamber, the valve being operable to permit dust within the dust collection chamber to pass through the access port for collection within the primary cleaner.

30. A suction cleaner according to claim 29, wherein the access port constitutes a collection inlet through which dust is collected into the dust collection chamber.

31. A suction cleaner according to claim 29, wherein the auxiliary cleaner further includes a collection inlet through which dust is drawn by the auxiliary cleaner, the collection inlet being separate from the access port.

32. A suction cleaner according to claim 31, wherein, when the auxiliary cleaner is attached to the primary cleaner, the collection chamber of the auxiliary cleaner constitutes part of the air channel.

33. A suction cleaner according to claim 32, wherein the primary cleaner includes a collection opening at an upstream end of the air channel, and the collection chamber of the auxiliary cleaner constitutes a part of the air channel downstream of the collection opening.

34. A suction cleaner according to claim 28, wherein the primary cleaner includes a power receiving terminal, and the auxiliary cleaner includes a power source for supplying power to the auxiliary cleaner, and a power supplying terminal connectable to the power receiving terminal of the primary cleaner when the auxiliary cleaner is attached thereto.

35. A suction cleaner according to claim 34, wherein the auxiliary cleaner includes a power transfer device for delivering power from the power supply cable to the primary cleaner alone when the auxiliary cleaner is attached to the primary cleaner.

* * * * *

UNITED STATES PATENT AND TRADEMARK OFFICE

CERTIFICATE OF CORRECTION

PATENT NO. : 6,122,796

DATED : September 26, 2000

INVENTOR(S) : Downham et al.

It is certified that error appears in the above-indentified patent and that said Letters Patent is hereby corrected as shown below:

Column 8, line 12, delete "416", and insert therefor --116--.

Signed and Sealed this

Tenth Day of April, 2001

*Attest:*

Nicholas P. Godici

NICHOLAS P. GODICI

*Attesting Officer*

*Acting Director of the United States Patent and Trademark Office*